United States Patent [19]

Newton et al.

[11] Patent Number: 4,711,079

[45] Date of Patent: Dec. 8, 1987

[54] ROVING BLENDING FOR MAKING SHEATH/CORE SPUN YARN

[75] Inventors: Feaster H. Newton, Asheboro; Kenneth Y. Wang, Greensboro, both of N.C.

[73] Assignee: Burlington Industries, Inc., Greensboro, N.C.

[21] Appl. No.: 824,788

[22] Filed: Jan. 31, 1986

[51] Int. Cl.[4] ..... D02G 3/04; D02G 3/38; D01H 5/00

[52] U.S. Cl. ..... 57/12; 57/315

[58] Field of Search ..... 57/2, 6, 12, 315

[56] References Cited

U.S. PATENT DOCUMENTS

| | | | |
|---|---|---|---|
| 2,358,656 | 9/1944 | Nutter et al. | 57/315 |
| 2,859,583 | 11/1958 | Parker . | |
| 3,255,579 | 6/1966 | Price . | |
| 3,342,028 | 9/1967 | Matsubayashi et al. . | |
| 3,370,410 | 2/1968 | McKew et al. . | |
| 3,596,458 | 8/1971 | Hiroshi et al. | 57/315 X |
| 4,263,777 | 4/1981 | Wada et al. . | |
| 4,307,566 | 12/1981 | Murata et al. . | |
| 4,470,253 | 9/1984 | Schulz et al. . | |
| 4,495,761 | 1/1985 | Nakayama et al. | 57/12 X |

FOREIGN PATENT DOCUMENTS

| | | | |
|---|---|---|---|
| 51-75131 | 4/1976 | Japan . | |
| 51-133556 | 11/1976 | Japan . | |
| 5335051 | 11/1976 | Japan . | |
| 51-143735 | 12/1976 | Japan . | |
| 52-74040 | 6/1977 | Japan | 57/12 |
| 55-7032 | 4/1980 | Japan . | |
| 55-51835 | 4/1980 | Japan . | |
| 55-116824 | 9/1980 | Japan . | |
| 11775 | 3/1981 | Japan . | |
| 57-5924 | 1/1982 | Japan . | |
| 58-41916 | 3/1983 | Japan . | |
| 58-104224 | 6/1983 | Japan . | |

*Primary Examiner*—Donald Watkins
*Attorney, Agent, or Firm*—Nixon & Vanderhye

[57] ABSTRACT

A ring spun yarn having good core cohesiveness, and complete sheath covering, the sheath comprising first fibers, such as cotton, and the core comprising second fibers having distinctly different properties than the first fibers, such as polyester, is produced. A sliver of first fibers and a roving of second fibers are fed to a drafting apparatus so that the roving is at the exact center line of, and on top of, the sliver. The roving and sliver are passed together through the rear rolls, apron, and front rolls of the drafting apparatus to produce a drafted composite sliver. Twist is imparted mechanically to the drafted composite sliver to produce a roving having a core and sheath. Then the roving is further drafted and twist is mechanically imparted thereto, producing a final core/sheath yarn. The sliver and roving are fed to the drafting apparatus with the roving at the exact center line position by passing them through a trumpet having a sliver guiding element with a generally oval shaped exit opening having about a 3-1 width to height ratio, and the roving guiding element is mounted on top of the sliver guiding element.

19 Claims, 9 Drawing Figures

FIG. 1
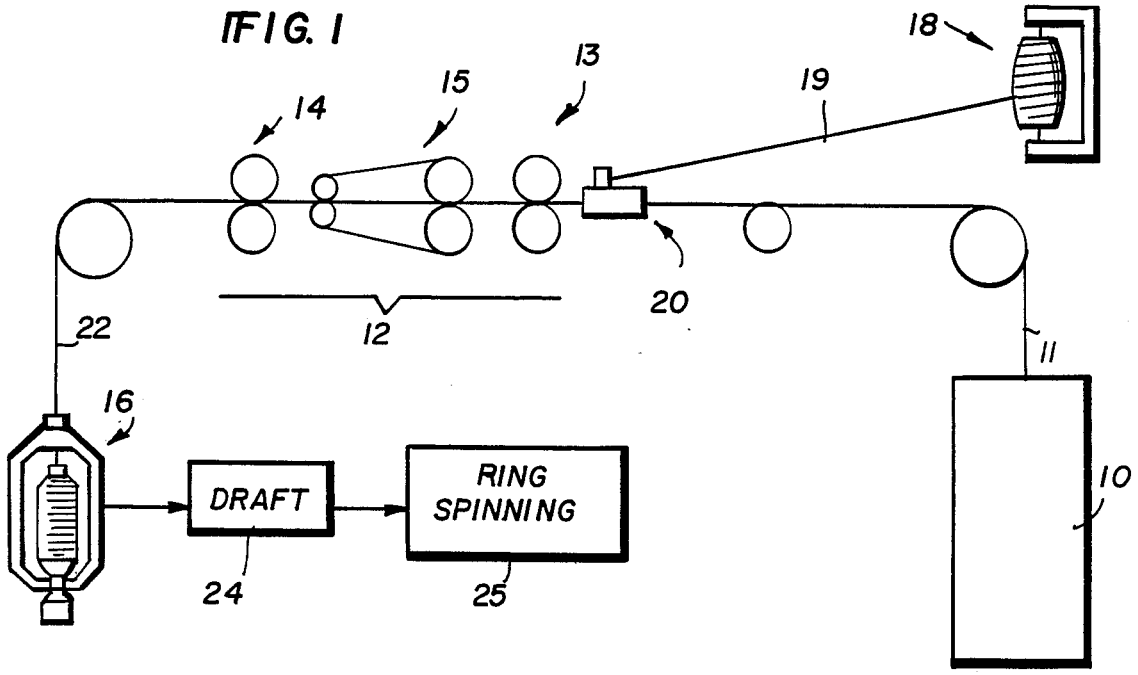
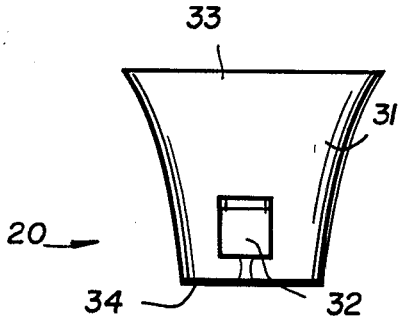
FIG. 2
FIG. 3
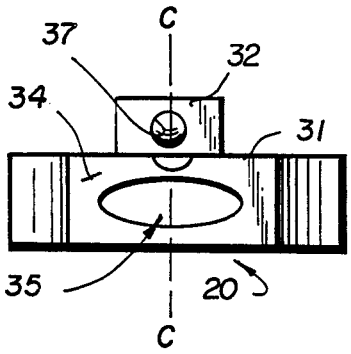
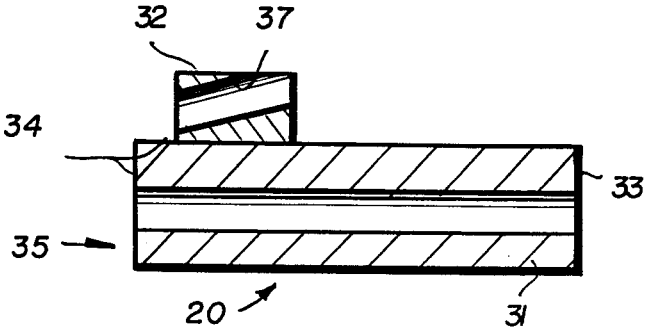
FIG. 4

FIG. 5
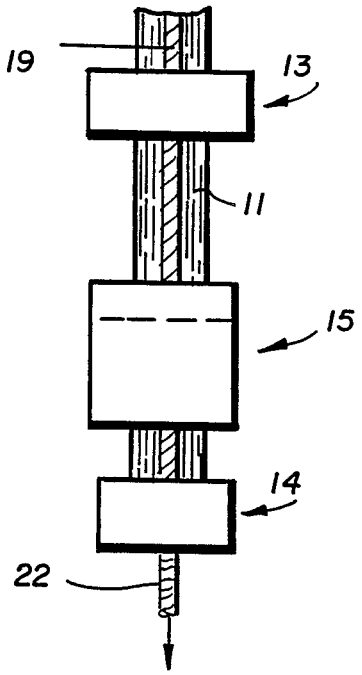
FIG. 6a
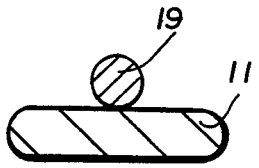
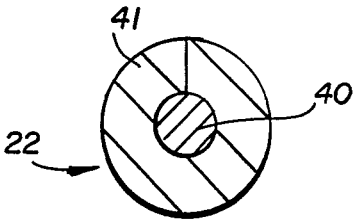
FIG. 6b
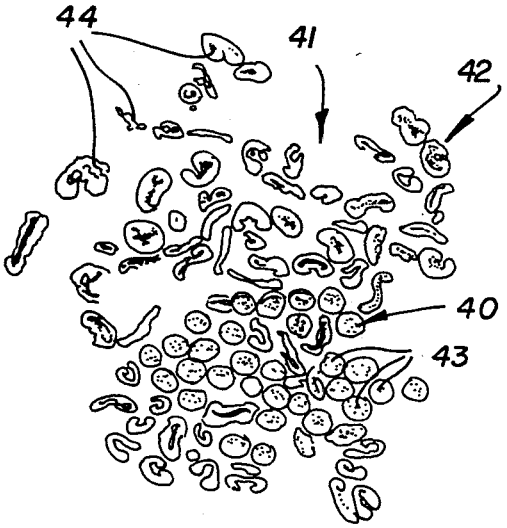
FIG. 7
FIG. 8
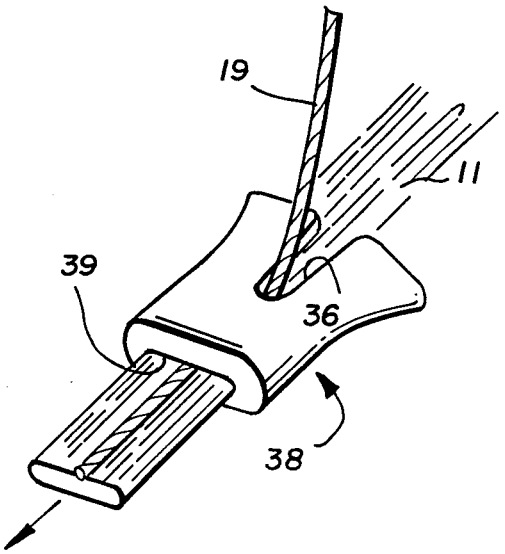

ROVING BLENDING FOR MAKING SHEATH/CORE SPUN YARN

BACKGROUND AND SUMMARY OF THE INVENTION

For many different purposes it is desirable to have a ring spun yarn with a distinct sheath/core configuration. For instance it is desirable to be able to produce ring spun yarns having different fibers in the core and the sheath which has most of the advantages of both the core and the sheath fibers. For instance in the production of yarn for sports shirts, it is desirable to have a yarn that has the feel of cotton, or like natural fibers, but has better strength. Also in the production of denim, and other heavyweight fabrics for pants and uniforms, it is desirable to have sheath/core configuration yarns so that the fabric has the feel imparted by one fiber, but the strength imparted by another. There have been many proposals for procedures in order to accomplish these results, which have met with varying degrees of success, but still there are few commercially acceptable ring spun sheath/core yarns.

According to the present invention it has been recognized that it is desirable to act upon the fibers which are to form the core and the sheath of a ring spun yarn in such a way as to maintain good core cohesiveness throughout processing, and to maintain the core and sheath fibers as distinct as possible. The ring spun yarn produced according to the invention has the core completely covered by the sheath fibers, and by varying the percentages of sheath/core fibers one can achieve different tactile and functional properties. By practicing the invention it is possible to optimize the fabric properties according to end use requirements.

According to the present invention a method of producing a roving having a sheath/core configuration, utilizing a drafting apparatus comprising front and back rolls with an apron therebetween, is provided. The method comprises the steps of: (a) Feeding a sliver of first fibers and a roving of second fibers to the drafting apparatus so that the roving of second fibers is at the center line of, and on top of, the sliver of first fibers. The first and second fibers have distinctly different properties. For instance the sheath fibers can be soft natural fibers, such as cotton or wool, while the core fibers can be synthetic fibers, such as polyester, nylon, and other synthetic fibers in staple form. (b) The roving and sliver are passed together through the rear rolls, apron, and front rolls of the drafting apparatus to produce a drafted composite sliver. Then, (c) mechanical twist is imparted to the drafted composite sliver by a roving frame to produce a roving having a core and sheath covering the core.

By carefully controlling the fiber cohesiveness, one can ensure that the core and the sheath remain entirely distinct. Core cohesiveness can be maintained by: particularly controlling the twist of the roving of second fibers (e.g. so that it has a twist multiple of about 0.25–0.80 turns per inch); and/or applying a finish to the roving of second fibers so that it has high friction than the first fibers; and/or passing the sliver and roving through a trumpet so as to precisely control the placement of the roving on top of the sliver so that the roving is at the exact center line of the sliver, and has no opportunity to move off the exact center line before passing to the rear rolls. Once the sliver and roving pass together to the rear rolls, the drafting apparatus will have a tendency to move the first fibers of the sliver to completely surround the second fibers of the core, and not intermix them. As the two fiber bands move out of the front roll, the twisting action of the flyers will cause the complete covering of the sheath fibers around the core fibers.

According to the method of the present invention, it is possible to produce spun yarn from the composite roving produced above merely by subjecting the roving to another conventional draft stage, and then mechanically spinning it on a spinning frame. Typically the drafting in step (b) above would provide a draft ratio of about 10-1, while the drafting in the second drafting stage, prior to yarn spinning, would be at a draft ratio of about 6-1.

The invention also comprises particular apparatus for producing the sheath/core yarn. The apparatus includes conventional components for producing a roving from sliver, and also comprises a support for the roving of second fibers, and a trumpet between the support and the rear rolls of the drafting apparatus. The trumpet guides the roving and sliver together to the rear rolls of the drafting apparatus so that they are in the particular desired arrangement, with the roving on top of the sliver and at the exact center line thereof. The trumpet includes a sliver guiding element which necks down from the sliver supply to the drafting apparatus, and has a generally oval shaped opening with a 3-1 width to height ratio through which the sliver exits. The trumpet also comprises a roving guiding element mounted on top of the sliver guiding element, for guiding the roving so that it is disposed at the exact center line of, and on top of, the sliver and so that the roving has no chance to move before the roving and sliver go together to the nip of the rear rolls of the drafting apparatus.

It is the primary object of the present invention to provide an improved method and apparatus for producing sheath/core yarn, where the yarn has a cohesive core and the sheath completely covers the core. This and other objects of the invention will become clear from an inspection of the detailed description of the invention, and from the appended claims.

BRIEF DESCRIPTION OF THE DRAWINGS

FIG. 1 is a schematic side view of exemplary apparatus according to the present invention;

FIGS. 2 through 4 are top plan, front end, and longitudinal cross-sectional views, respectively, of the trumpet component of FIG. 1;

FIG. 5 is a schematic top plan view of the drafting part of the apparatus of FIG. 1 shown in conjunction with the sliver and roving;

FIGS. *6a* and *6b* are schematic cross-sectional views of the sliver and roving prior to drafting, and the final composite roving after drafting, respectively;

FIG. 7 is a drawing simulating an enlargement of a photomicrograph of a yarn according to the present invention, showing the distinct core and sheath arrangement thereof, with polyester fibers in the core and cotton fibers in the sheath; and FIG. 8 is a schematic showing of the utilization of another embodiment of trumpet according to the present invention, in cooperation with a sliver and roving.

DETAILED DESCRIPTION OF THE DRAWINGS

Exemplary apparatus according to the present invention is shown in FIG. 1, for producing a composite roving. Conventional components of the apparatus of FIG. 1 include the sliver can 10 from which a sliver 11 of first fibers is drawn, a drafting apparatus 12 which comprises a pair of rear rolls 13, a pair of front rolls 14, and an apron 15 intermediate the rolls 13, 14, and a roving spinning frame 16. According to the present invention, in addition to the conventional components heretofore described, there is provided a supply 18 of a roving of second fibers, which have distinctly different properties than the first fibers. For instance the sliver 11 can be of cotton or like short staple fibers, while the roving 19 from roving supply 18 is of polyester or like synthetic long staple fibers. The invention also comprises a trumpet 20 disposed between the supplies 10, 18 and the rolls 13. The roving 22 which is produced according to the present invention has a distinct sheath and core arrangement, and to make the roving 22 into yarn one passes it through a conventional second draft stage 24 and then to a yarn spinning frame 25 for ring spinning the roving into yarn. The drafting apparatus 12 typically would apply a draft ratio of about 10-1, while the second draft apparatus 24 would typically apply a draft ratio of about 6-1.

The trumpet 20 according to the present invention is illustrated more clearly in FIGS. 2 through 4. The purpose of the trumpet 20 is to precisely segregate the roving 19, which will provide the core for the composite roving 22, and the sliver 11 prior to feeding them to the drafting apparatus 12, so that the core maintains core cohesiveness and the sheath fibers completely cover the core, in the final roving 22.

To effect its purpose, the trumpet 20 utilizes a first portion 31 which is a guiding element for the sliver 11, and a second portion 32 which is a guiding element for the roving 19. As seen most clearly in FIGS. 2 and 3, the portion 31 necks down from a first end 33 thereof, which has a relatively large opening and into which the sliver 11 is fed, to the second end 34 thereof which has a generally oval shaped opening 35 (see FIG. 3) which is smaller than the opening at the first end 33. Preferably the exit opening 35 has a width-height ratio of 3:1 which provides proper compaction of the sliver while maintaining a desired thickness.

A ratio of about 3:1 is desirable since the yarn being produced is preferably approximately circular in cross-section. The circumference of a circle is $\pi d$, and of course $\pi$ is approximately 3. If the width to height ratio is much greater than 3, e.g. 4 or 5, then the sliver is made too thin in the bottom of the core roving band, and too thick at the top. This unevenness promotes exposure of the core fibers. On the other hand, if the width/height ratio is much smaller than 3, e.g. 2, then the sheath fibers cannot fully cover the core fibers all around the circumference, again resulting in exposure of the core fibers.

The degree of compaction also can be a significant factor. Adequate compaction permits the sheath fibers greater cohesion and thus less mixing with the core fibers. Therefore as the sheath fibers are made to cover the core fibers, they form a more cohesive sheath.

The roving guiding element 32 has a substantially circular shaped bore 37 therein Which slants downwardly from the portion thereof closest to the end 33, to the portion thereof closest to the end 34. The diameter of the bore 37 is just slightly greater than, or the same size as, the natural diameter of the roving 19. The element 32 is mounted on top of and at the exact center line C—C (see FIG. 3) of the exit opening 35 so that the roving 19 is laid down on top of the sliver 11 at the exact center line thereof. Also, the degree of slant of the bore 37 is dimensioned with respect to the spacing of the trumpet 20 from the rolls 13 so that there is no opportunity for the roving 19 to wander to deviate from the center line of the sliver 11 prior to being fed to the nip of the rolls 13. The roving 19 and the sliver 11 just at the point that they are being fed to the nip rolls 13 can be seen in FIG. 6*a*. Also the relative positions thereof can be seen from FIG. 5.

FIG. 8 illustrates another exemplary trumpet according to the present invention. The trumpet 38 of FIG. 8 can be utilized in place of the trumpet 20 seen in FIG. 1. In this embodiment the sliver 11 and roving 19 are placed in proper juxtaposition to each other within the trumpet itself prior to passing through the generally oval configuration exit opening 39, the trumpet 38 also necking down from the entrance to the exit thereof. The roving 19 is added in this embodiment through a slot 36 formed in the top of the trumpet 38, the slot 36 having the same width as the roving 19, and being disposed at exactly the center line of the exit opening 39.

In order to ensure good cohesiveness of the core of the composite roving being produced, various properties thereof will be controlled. One way to control core cohesiveness is by controlling the twist imparted to the roving 19 (that is the twist that the roving 19 has when it is utilized in the apparatus of FIG. 1). The apparatus is operable to produce the desired yarn according to the present invention when the twist multiple of the roving 19 is anywhere within the range of about 0.25–1.25 turns per inch, however it is desired that the twist multiple of the roving 19 be within the range of about 0.25–0.8 turns per inch, and preferably within the range of about 0.5–0.75. Another way to control core cohesiveness is by controlling the relative frictional properties of the fibers of the roving 19 and the sliver 11. For instance the roving 19 can be treated with finish so that the fibers thereof have higher friction than the fibers of the sliver 11. Where the fibers of the roving 19 naturally have higher frictional properties (such as when the roving 19 is polyester and the sliver 11 is cotton), such finishing may not be necessary, but may be desirable even under such circumstances in order to properly and precisely control the core cohesion. Another way of controlling core cohesion is to make sure that the roving 19 is placed at the exact center line of the sliver 11, and maintaining a slight tension as by utilizing the trumpet 20 heretofore described.

The roving 22 produced according to the present invention is illustrated schematically in FIG. 6*b*, having a core 40 that is cohesive and essentially completely distinct from the sheath 41, the sheath 41 completely covering the core, and the core 40 comprising the second fibers and the sheath 41 comprising the first fibers.

While the invention has been described primarily with respect to the utilization of polyester core and cotton sheath fibers, it is to be understood that a wide variety of other fibers can also be employed. In many circumstances it is desirable, however, to provide the sheath fibers that have good aesthetic and/or tactile properties, while the core fibers are relatively speaking inexpensive, but have good strength properties. Usually the sheath fibers will be wool, cotton, or the like, while the core fibers will be nylon, polyester, or like synthetic staple fibers.

The roving 22 according to the present invention can be spun into yarn utilizing entirely conventional second drafting apparatus 24 and a spinning frame 25. A cross-section of an exemplary final yarn 42 according to the present invention is seen in FIG. 7. As is readily apparent from an inspection of FIG. 7, the core 40, which comprises the polyester (generally round) fibers 43, is extremely cohesive, while the sheath 41, comprising the amoeba shaped cotton fibers 44, completely covers the core 40, with little intermixing between the core and the sheath.

Several general examples of the practice of the method according to the present invention to produce spun core/sheath yarn are as follows:

EXAMPLE 1

A sheath/core yarn is spun from a sheath/core roving. This roving is made with 100 percent cotton sliver and 2 ends of 1.1 Hank Roving (twist multiple about 0.71 tpi), using a conventional Rovomatic frame where the rovings are fed together with the sliver as shown in FIG. 1. The resulting yarn is 25P/75C 26's cotton count and is shown schematically in FIG. 7. It is apparent from this diagram that the polyester (43) stays essentially in a cluster in the core of the yarn while the cotton fibers (44) form the sheath. When this yarn is knitted into a fabric and the fabric dyed with a cotton dye, there is very little trace of undyed polyester, meaning that there is an excellent cotton cover for the yarn. The fabric also has a soft and luxurious hand.

EXAMPLE 2

A yarn is processed in the following manner using a 0.75 HR fed with 56 grain/yd. sliver through the roving draft zone.

Position 1: Roving on top of sliver with 4 wraps on presser.

Position 2: Roving on top of sliver with 2 wraps on presser.

Position 3: Roving on top of sliver with 1 wraps on presser.

The wrapping on the presser provides for winding tension. The greater the wrap, the higher the winding tension and the greater the cohesiveness of the roving bundle. The resulting yarn has a 17 percent polyester core and 83 percent cotton sheath. This yarn was knitted into a fabric and dyed. There is no showing through of the undyed polyester, indicating a good cotton cover in all three positions, and three unwinding tensions.

EXAMPLE 3

A roving is prepared similar to Example 1. One strand of 0.55 Hank roving (TM=about 0.71 tpi) is combined with a 100 percent cotton sliver and a 20's yarn of 32 percent polyester and 68 percent cotton is spun. The yarn is knitted into fabric in a production machine and then dyed (cotton dye). Very little undyed polyester is seen. Furthermore, the dye is very uniform, indicating good spindle-to-spindle repeatability. The fabric also has a soft and luxurious hand.

EXAMPLE 4

Twelve spindles of a roving frame are converted with a special trumpet, such as shown in FIG. 8, and approximately 100 lbs. of yarn are spun. One strand of 0.51 HR of polyester is combined with a 39 gr/yard cotton sliver. Quantities of 32's and 40's yarn are spun. The yarns are knitted into sleeves and dyed to indicate the cotton. Again, very little undyed polyester is shown. The fabrics have a very soft and natural hand.

It will thus be seen that according to the present invention a method and apparatus have been provided for efficiently and effectively producing a sheath/core yarn having good core cohesion, and with the sheath completely covering the core. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A method of producing a yarn having a sheath and core configuration, utilizing a drafting apparatus comprising front and back rollers, with an apron therebetween, comprising the steps of:

(a) feeding a sliver of first fibers, and a roving of second fibers, the second fibers having distinctly different properties than the first fibers, to the drafting apparatus so that the roving of second fibers is at the center line of, and on top of, the sliver of first fibers;

(b) passing the roving and sliver together through the rear rolls, apron, and front rolls of the drafting apparatus to produce a drafted composite sliver; and (c) mechanically imparting a twist to the drafted composite sliver to produce a roving having a core and a sheath covering the core, the roving of second fibers being a roving having a twist multiple of about 0.25–0.8 turns per inch.

2. A method as recited in claim 1 wherein the roving of second fibers has a twist multiple of about 0.5–0.75 turns per inch.

3. A method as recited in claim 1 wherein step (a) is practiced by passing the sliver and roving through a trumpet to place the roving on the exact center line of the sliver to facilitate maintaining core cohesiveness.

4. A method as recited in claim 3 wherein step (a) is further practiced by producing a generally flat configuration for the sliver as it exits the trumpet.

5. A method as recited in claim 4 wherein step (a) is further practiced by providing a substantially 3-1 ratio of sliver width to height at the point where the sliver exits the trumpet.

6. A method as recited in clam 1 wherein the sliver of first fibers comprises short staple fibers, and wherein the roving of second fibers comprises long staple fibers.

7. A method as recited in claim 6 wherein the sliver of first fibers comprises cotton fibers, and wherein the roving of second fibers comprises polyester fibers.

8. A method as recited in claim 1 wherein the first fibers comprise fibers having good aesthetic properties, and the second fibers comprise fibers that are less expensive than the first fibers and have good strength properties.

9. A method as recited in claim 1 comprising the further step of maintaining the cohesiveness of the roving of second fibers in the core of the sheath and core configuration of roving produced.

10. A method as recited in claim 9 wherein said step of maintaining the core cohesiveness is accomplished by finishing the roving of second fibers before practicing step (a), so that the roving fibers have higher friction than the first fibers.

11. A method as recited in clam 9 wherein said maintaining core cohesiveness step is practiced by providing the roving of second fibers in step (a) with a twist multiple of about 0.5–0.75 turns per inch.

12. A method as recited in claim 9 wherein said step of maintaining core cohesiveness is accomplished by practicing step (a) so that the roving of second fibers is at the exact center line of the sliver and has no opportunity to move off the exact center line before passing to the rear rolls of the drafting apparatus.

13. A method of producing a yarn having a core with good core cohesiveness, and completely covered by a sheath, the fibers of the core and the sheath having distinctly different properties, comprising the steps of:

(a) feeding a sliver of first fibers, and a roving of second fibers, the second fibers having distinctly different properties than the first fibers, to a drafting apparatus so that the roving of second fibers is at the center line of, and on top of, the sliver of first fibers;

(b) passing the roving and sliver together through a pair of rear rolls, an apron, and a pair of front rolls of the drafting apparatus to produce a drafted composite sliver;

(c) imparting a twist to the drafted composite sliver to produce a roving having a core and a sheath covering the core; and (d) effecting further drafting of the roving, and then mechanically imparting twist to the further drafted roving, to produce a yarn having a cohesive core of second fibers, and completely covered by a sheath of first fibers, the roving of second fibers being a roving having a twist multiple of about 0.25–0.8 turns per inch.

14. A method as recited in claim 13 wherein the sliver of first fibers comprises short staple fibers, and wherein the roving of second fibers comprises long staple fibers.

15. A method as recited in claim 13 wherein the sliver of first fibers comprises cotton fibers, and wherein the roving of second fibers comprises polyester fibers.

16. A method as recited in claim 13 wherein step (b) is practiced to provide approximately a 10-1 draft ratio, and wherein step (d) is practiced to provide approximately a 6-1 draft ratio.

17. Apparatus for producing a roving having a cohesive core of second fibers, completely covered by a sheath of first fibers having distinctly different properties than the second fibers, comprising:

a second supply for a sliver of first fibers;

a supply means for a roving of second fibers;

drafting apparatus comprising a rear set of rollers, a front set of rollers, and an apron intermediate the front and rear sets of rollers;

means to operate the draft apparatus at a 10-1 draft ratio;

a trumpet between said supply means and said rear rolls, said roving and sliver both operatively passing through said trumpet; and a roving spinning frame on the opposite side from said drafting apparatus as said trumpet; and wherein said trumpet comprises a sliver guiding element which necks downwardly from said supply means to said rear rolls, and has a substantially oval shaped exit opening.

18. Apparatus as recited in claim 17 wherein the substantially oval shaped opening of the sliver guiding element has approximately a 3-1 ratio, width to height.

19. Apparatus as recited in claim 17 further comprising a roving guiding element mounted above said sliver guiding element, for guiding a roving so that it moves from said roving supply means to a position above, and at substantially the exact center line of, the sliver prior to the rear rolls.

* * * * *